United States Patent [19]

Roestenberg

[11] Patent Number: 4,732,104

[45] Date of Patent: Mar. 22, 1988

[54] BOW THRUSTER

[76] Inventor: Frank Roestenberg, 47 Park Ave., Port Washington, N.Y. 11050

[21] Appl. No.: 909,189

[22] Filed: Sep. 19, 1986

Related U.S. Application Data

[63] Continuation-in-part of Ser. No. 785,587, Oct. 8, 1985, abandoned.

[51] Int. Cl.[4] ..... B63H 25/46

[52] U.S. Cl. ..... 114/151; 440/58

[58] Field of Search ..... 114/147, 151, 126, 280; 440/5, 6, 53-63, 900; 244/56

[56] References Cited

U.S. PATENT DOCUMENTS

| | | | |
|---|---|---|---|
| 1,443,572 | 1/1923 | Gosline | 244/56 |
| 3,251,330 | 5/1966 | Honeger | 114/147 |
| 3,580,212 | 5/1971 | Fortson | 440/6 |
| 3,980,039 | 9/1976 | Henning | 440/60 |
| 4,208,978 | 6/1980 | Eller | 114/51 |
| 4,223,625 | 9/1980 | Puretic | 440/61 |

FOREIGN PATENT DOCUMENTS

| | | | |
|---|---|---|---|
| 3001701 | 7/1981 | Fed. Rep. of Germany | 114/147 |
| 20136 | of 1913 | United Kingdom | 440/53 |

*Primary Examiner*—Joseph F. Peters, Jr.
*Assistant Examiner*—Jesûs Sotelo
*Attorney, Agent, or Firm*—Steinberg & Raskin

[57] ABSTRACT

A pivotal bow thruster adapted to be adjustably pivoted about a stem of a boat, which enhances attainment of smooth, safe docking of the boat, with better control, and minimal difficulty. The bow thruster comprises two propellers which, when spinning, thrust the bow of the boat to starboard or to port, and a mechanism for pivoting the propellers about the stem of the boat. This pivoting mechanism comprises a pivoting arm coupled to the propeller unit and a gear train which, when activated, rotates the pivoting arm.

22 Claims, 18 Drawing Figures

FIG. 17
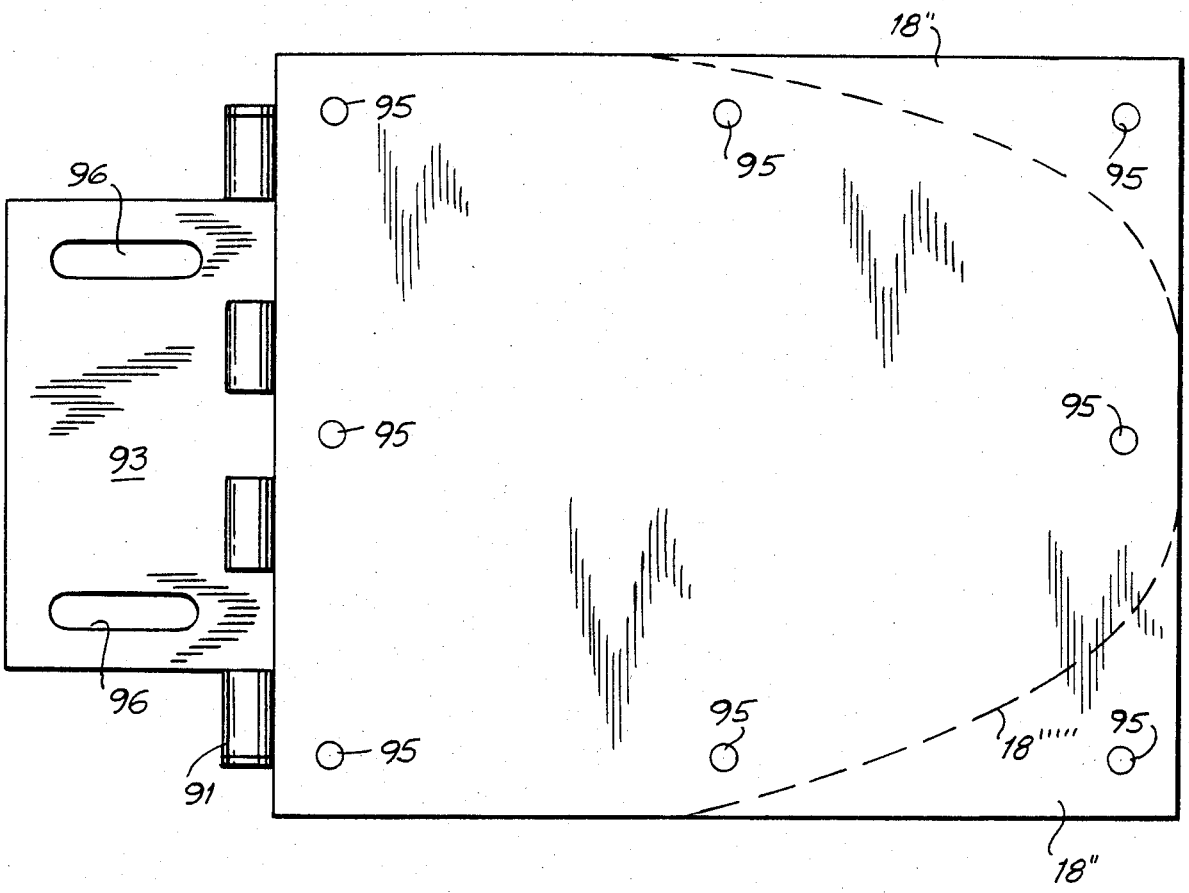
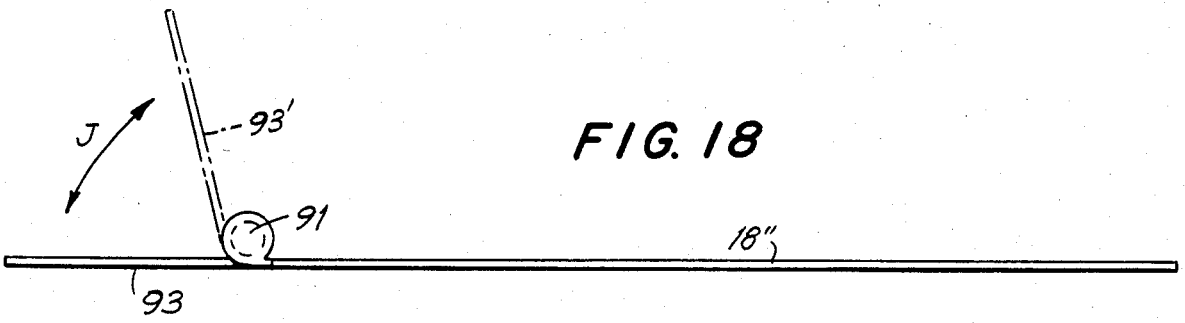
FIG. 18

BOW THRUSTER

CROSS REFERENCE TO RELATED APPLICATIONS

The present application is a continuation-in-part of copending application Ser. No. 785,587, filed Oct. 8, 1985, now abandoned.

BACKGROUND OF THE INVENTION

The present invention is directed to a bow thruster, for thrusting the bow of a boat in one direction or another, e.g., laterally to starboard or to port, to provide for a controlled, smooth docking maneuver of the boat. More particularly, the present invention is directed to a bow thruster which may be adjustably situated with respect to a stem of the boat.

Docking of water craft has generally been the most tricky maneuvering of a boat. There is not much room in adockage for maneuvering the water craft. Accordingly, a boat has to be brought into the docking area at extremely slow speed, often at or below the minimal speed required for steerage and control. Conventional power craft, or sailing vessels with an engine, are generally provided with a propeller system that rotates clockwise, when viewed in a direction facing the bow of a boat. Accordingly, this clockwise rotation of the propeller blades will tend to kick the bow of the boat laterally to port, when in forward gear. When the boat is in reverse gear, the counter clockwise rotation of the propeller blade will tend to kick the bow of the boat laterally to starboard.

Thus when approaching a dock in forward or reverse gear, the bow of the boat will tend to swing in a lateral direction, to port or to starboard. This lateral swing will become extremely pronounced, when the boat is moving at the extremely slow speeds required for safe, smooth docking. Therefore, such lateral swinging of the bow of the boat will interfere with the accomplishment of such smooth, safe docking, making it more difficult to dock the water craft, and increasing the hazards of such docking maneuvers.

Accordingly, devices known as bow thrusters have come into use for minimizing this undesired lateral swinging of the bow of the boat. Basically, these bow thrusters operate on the principle of creating force to counteract the unwanted lateral swinging of the bow of the boat, to thereby stabilize the lateral position of the bow. Such conventional bow thrusters involve disposition of a motorized propeller beneath the water line adjacent the bow of a boat, whereby rotation of the propeller blade in one direction or another can be actuated to counteract the unwanted lateral movement of the bow, i.e., by "thrusting" the bow of the boat in the opposite direction.

U.S. Pat. No. 4,223,625 discloses an outboard thruster for maneuvering a marine vessel, which is normally stowed on board the vessel. The motor-propeller unit forming this thruster is lowered into a submerged position by a retractable davit mounted on board the vessel. The motor propeller unit is connected through various cables and lines to the raising/lowering mechanism mounted on the deck of the boat.

U.S. Pat. No. 4,294,186 discloses a retractable bow thruster mounted directly within the hull of a boat. Other examples of bow thrusters may be found in U.S. Pat. No. 3,251,330 which discloses a bow thruster being lowered by a hoisting mechanism disposed on the bow of the boat through a series of interconnected links, and U.S. Pat. No. 4,208,978, which discloses a bow thruster adapted to slide along guide rods rigidly mounted upon the hull of a boat.

However, these types of conventional bow thrusters all involve considerably complicated, cumbersome arrangements, and are not feasible to activate or de-activate, especially in the extremely close quarters located in andaround dockages. Such complicated arrangements make it extremely difficult for an inexperienced crew member to activate the bow thrusters, making it necessary for a more experienced crew member to operate the same. This increases the hazards encountered on docking a vessel, because the attention of a more experienced crew member is taken away from the delicate maneuvering required in the docking of a boat. Also, the complicated nature of such thruster arrangements increase the likelihood of failure occurring in the operation thereof, especially in the raising or lowering of the respective thrusters, because a great deal of interacting components is involved.

Such types of thruster arrangements require a great deal of space for the storage thereof, especially on board or on the deck of a boat. This consumes valuable needed space upon or in a water vessel, which is always at a premium. Additionally, special mountings or fixtures for such bow thrusters are required, especially for the type mounted within the hull of a boat.

SUMMARY OF THE INVENTION

Accordingly, it is an object of the present invention to provide a new and improved type of bow thruster.

It is also an object of the present invention to provide for a less complicated and less cumbersome type of bow thruster arrangement which can be conveniently raised or lowered into position.

It is another object of the present invention to provide for better control of thrusting of the bow of a boat upon the docking thereof.

It is a further object of the present invention to provide a bow thruster having less exposed components on or in the deck of a boat.

It is still another object of the present invention to provide a bow thruster which is more feasibly transferred from boat to boat.

It is still a further object of the present invention to increase conservation of space on or in a boat.

It is yet another object of the present invention to increase safety and diminish hazards upon the docking of a water craft.

It is yet a further object of the present invention to provide for better utilization of the talents of the crew on board a vessel, during the docking thereof.

These and other objects are attained by the present invention which provides a pivotal bow thruster that is adapted to be adjustably situated with respect to a stem of a boat. The thruster may be pivoted about the stem of the boat to an active position below the water line and adjacent the stem of the boat, or to an inactive position where the thruster unit itself is situated adjacent the bow or bowsprit of the vessel.

The bow thruster comprises a thrusting unit which may include e.g., a motor and two propellers, this unit being pivoted about the stem of the boat by being connected to pivoting means thereof. The pivoting means are disposed on the stem of the boat and are interconnected with the thrusting unit through a pivotal rod, for example.

More particularly, the pivoting means comprise a gear train engaged with the pivoting rod or arm. The gear train comprises at least one gear affixed to the pivoting arm, and a worm gear engaged with the same and with means for actuating the pivoting of the rod. When the worm gear is rotated about its axis, it in turn rotates the gear affixed to the pivoting arm which raises or lowers the same. Thus the thrusting unit is pivotal about the pivoting means on the stem of the boat through the rod, between the active and inactive positions noted above.

When the thruster unit is in the lower active position, the propeller is simply actuated to rotate in one direction or another within the water, thereby thrusting the bow of the boat in a particular lateral direction. The pivoting means may include a support or housing disposed on the stem of the boat, the housing or support in turn encompassing the gear train which is engaged with the pivoting rod or arm connected to the thruster unit itself. The gear train preferably comprises an intermediate gear to especially provide smooth, fast, and effective pivoting of the thruster unit between operative and inoperative positions.

Position of the thruster unit itself may be advantageously adjusted along the pivoting rod or arm as desired, to accommodate a particular water line of any type of vessel. When the thruster is in its raised or deactivated position, the thruster unit itself generally rests adjacent the bowsprit or bow pulpit, while in the activated, lowered position, the thruster unit is submerged below the water. Additionally, the thruster unit itself may comprise twin propeller blades affixed to a motor therewithin. Also the thruster unit and housing for the gear train may be formed with substantially V-shaped seats, so that these housings may be conveniently situated along the stem of a water craft.

The bow thruster of the present invention is extremely less complicated than previously-known bow thrusters, and may be conveniently situated along and pivoted about the stem of a water craft as desired, and may even be transferred from water craft to water craft as needed, with minimal amount of adjustment and accommodation required. As a result, the bow thruster of the present invention provides for much better utilization of space on board or in a water craft, as opposed to the previously-known thrusters which required a great deal of space to be stored on top of or within a boat. Also, movement of the thruster of the present invention into or out of operating position can be accomplished much more feasibly than concomitant adjustment of the previously-known bow thrusters.

These previously-known bow thrusters required a great deal of operating components for raising/lowering the respective thrusters into position. There is much less likelihood of any failure of the bow thruster of the present invention, since the number of such operating components has been dramatically reduced. Moreover, a less experienced crew member can conveniently operate the bow thruster of the present invention, thus freeing a more seasoned crew member for more difficult, delicate docking operation and maneuvering of the water craft. In fact, with the bow thruster of the present invention, positioning and operation thereof can be conveniently accomplished from any desired point upon the water craft, with minimal amount of inconvenience or increase of danger.

There is also a much smaller number of exposed operating components with the bow thruster of the present invention, greatly decreasing the chance of damage thereof which could possibly occur upon the delicate docking maneuvers. Moreover, as noted above, the bow thruster of the present invention can be conveniently moved from boat to boat as required, with minimal amount of disturbance to a vessel.

BRIEF DESCRIPTION OF THE DRAWINGS

The present invention will be further described in greater detail with reference to the accompanying drawings, in which.

FIG. 17 is a side view of a seat for mounting against the hull of a boat; and FIG. 18 is a top view of FIG. 17.

DETAILED DESCRIPTION OF THE PREFERRED EMBODIMENTS

Figure 1:
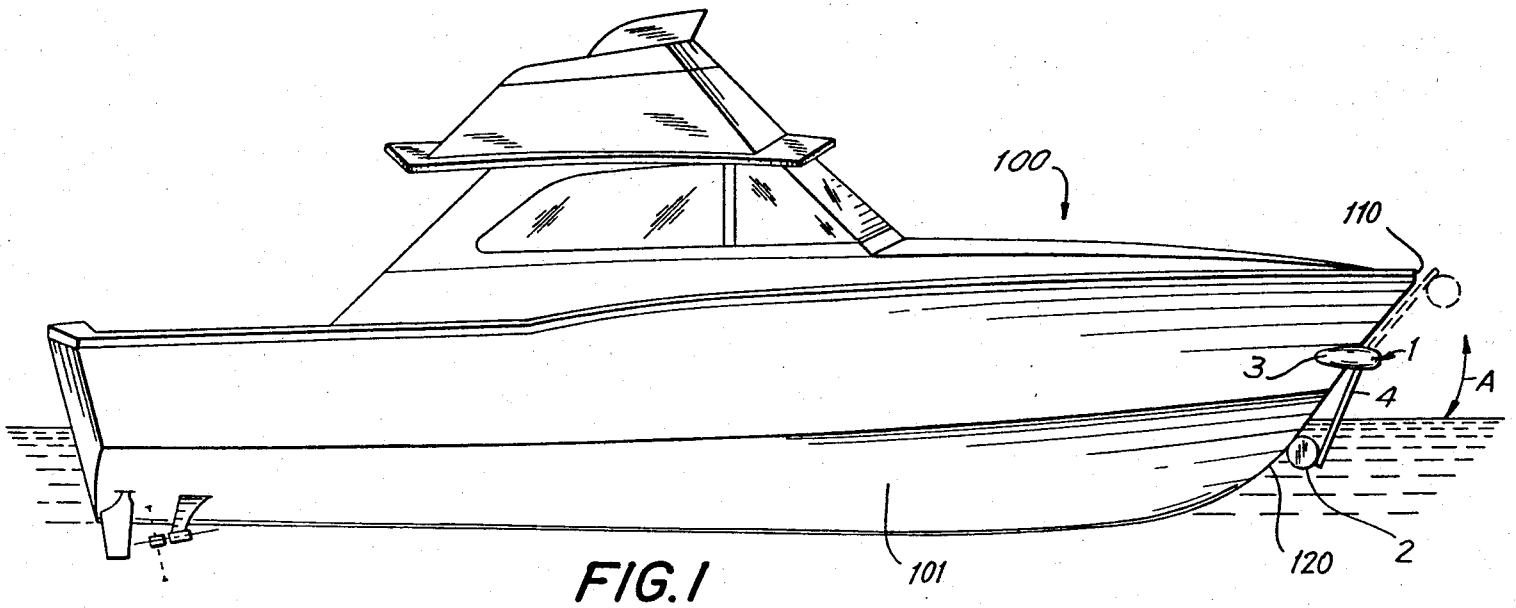
FIG. 1 is a side view of a water craft upon which the bow thruster of the present invention is disposed.

Referring to the figures, a water craft 100 is illustrated in FIG. 1, the bow thruster 1 of the present invention being pivotally disposed thereon, more particularly pivotally disposed about the stem 120 of the water craft 100. The illustrated water craft in FIG. 1 is a 38-foot Bertram, however, as noted above, the bow thruster 1 of the present invention may be conveniently mounted about the stem of any kind of water craft.

The bow thruster 1 of the present invention is mounted to be pivotal about the stem 120 of the boat 100 between an operative position where the thruster is submerged below the water, and an inoperative position where the thruster is raised above the water, this inoperative position being illustrated in phantom in FIGS. 1 and 2. More particularly, the bow thruster is pivotal in the direction of the double-headed arrow A in FIG. 1.

Figure 3:
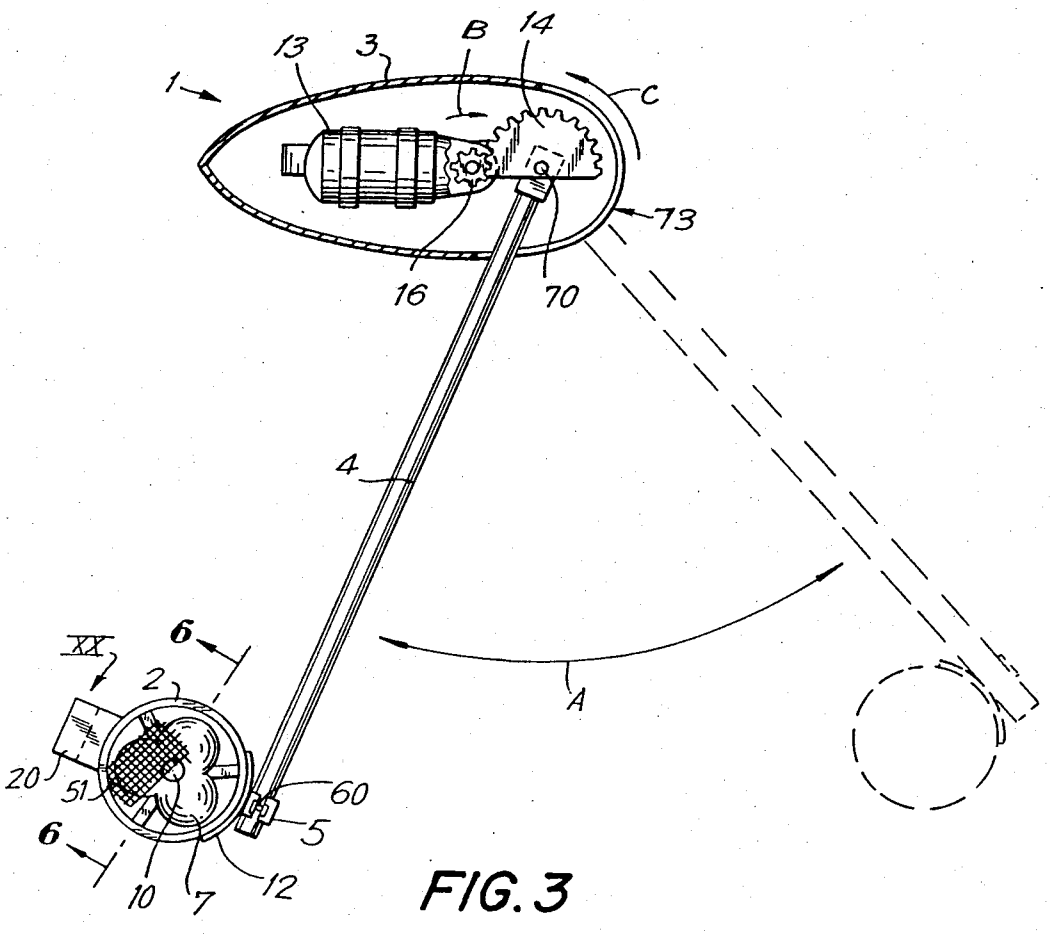
FIG. 3 is a side view, partially in section, of the bow thruster of the present invention illustrating positioning thereof.
Figure 6:
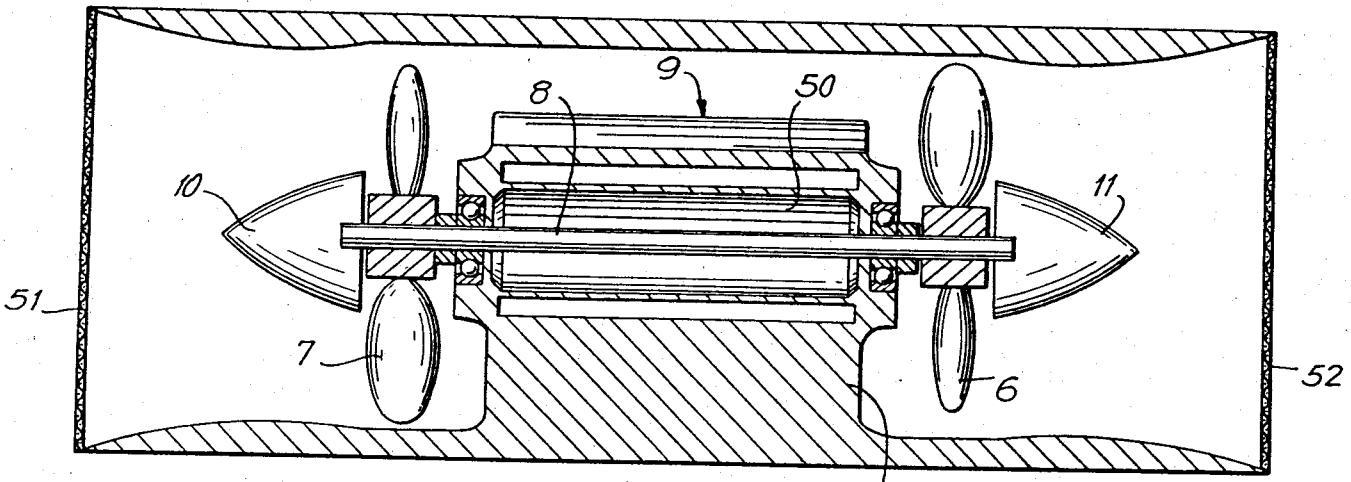
FIG. 6 is a sectional view along line 6—6 of FIG. 3.
Figure 7:
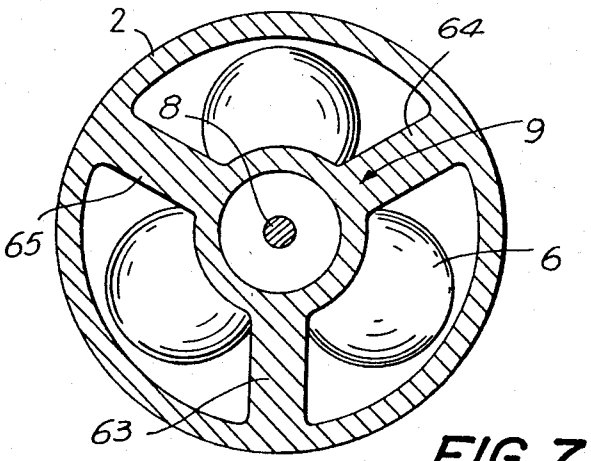
FIG. 7 is a sectional view along lines 7—7 of FIG. 4.

This pivotal movement of the bow thruster is illustrated in enlarged detail in FIG. 3. More particularly, the bow thruster 1 of the present invention comprises a thruster unit 2, for creating the force necessary to laterally move the bow of the boat in one direction or another. This thruster unit 2 is engaged with a pivoting mechanism 3, through a pivoting rod or arm 4. The thruster unit 2 comprises two propeller blades 6 and 7 which are engaged with a motor 50 disposed in a motor housing 9, through drive shaft 8, as illustrated in the sectional view of FIG. 6. Opposite ends of the drive shaft 8 adjacent the respective propeller blades 7 and 6, are provided with cowlings 10 and 11. Additionally, the thruster unit 2, which is substantially cylindrical in shape as illustrated in FIGS. 6 and 7, is provided with screens 51 and 52 at respective ends thereof, to prevent any debris from getting caught and entrained about the propeller blades 7 and 6. An automatic shut-off microswitch for the motor 50 is provided on the arm 4, so that the propellers 6 and 7 step turning when the unit 2 is raised out of the water.

Figure 10:
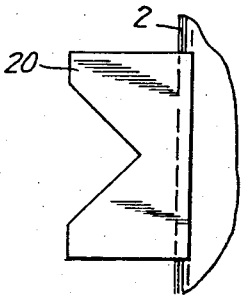
FIG. 10 is a view in the direction of arrow XX in FIG. 3 illustrating a substantially V-shaped seat for the thruster against the stem of the boat.

Also as illustrated in FIG. 3 and notably in FIG. 10, the thruster unit 2 is provided with a substantially V-shaped seat 20 so that the thruster unit 2 will comfortably, securely, seat against the stem 120 of the boat 100. At the same time, the thruster unit 2 may be conveniently pivoted to an inoperative position away from the hull 101 of the boat 100, because there are no other connections between the thruster unit 2 and the hull 101 of the boat 100.

Figure 4:
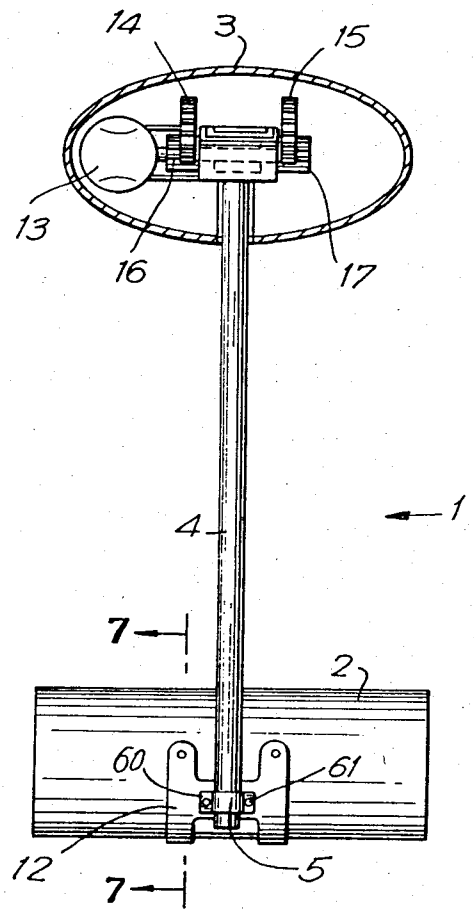
FIG. 4 is a front view, partially in section, of the bow thruster illustrated in FIG. 3.

The thruster unit 2 is affixed to the pivoting rod or arm 4 through a double bracket 12, as illustrated in FIG. 3 and particularly in FIG. 4. The bracket 12 is affixed to the thruster unit 2 itself, with another bracket 5 being affixed in turn to the bracket 12, about the pivoting rod 4 as illustrated in these figures. Therefore, the thruster unit 2 is securely affixed to the rod 4, and may be conveniently adjusted in position along the rod 4 as desired, e.g., to accommodate the water line of a particular type of water craft. The bracket 5 is tightened by respective adjustable bolts, such as illustrated at 60 and 61 in FIGS. 3 and 4. The thruster unit 2 is also provided with three supports 63, 64, 65 for the motor housing 9, as illustrated in FIGS. 7, 3 and 6.

Figure 2:
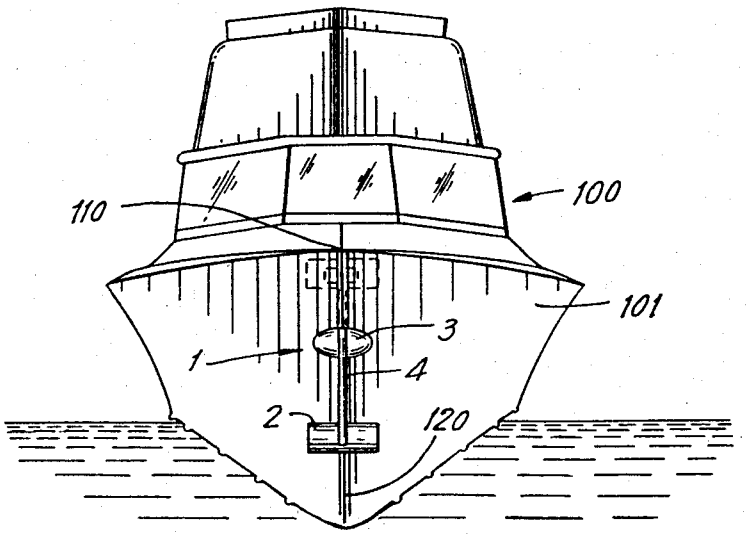
FIG. 2 is a front view of the water craft of FIG. 1, illustrating positioning of the bow thruster of the present invention.

The pivoting mechanism 3 comprises a housing 3 that is disposed along the stem 120 of the boat 100, as illustrated in FIGS. 1 and 2. More particularly, this housing 3 is substantially ovally-shaped in cross-section (FIGS. 3 and 4), and is also provided with a substantially V-shaped seat 18, as is the thruster unit 2, so that the housing 3 may securely rest along the stem 120 of the boat. The housing 3 is affixed to the hull 101 of the boat 100, through L-brackets and bolts (not illustrated).

Figure 5:
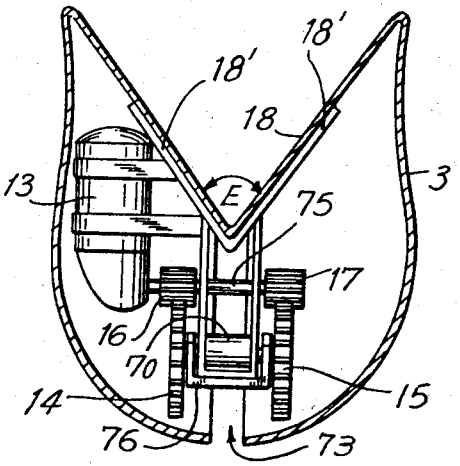
FIG. 5 is a top sectional view of the bow thruster of the present invention illustrated in FIGS. 3 and 4.

The interior of this housing 3 forming the pivoting mechanism, is provided with a pivoting motor 13, a drive gear engaged with the pivoting motor 13, and a half-moon gear meshingly engaged with the driving gear. As illustrated in FIGS. 3, 4 and 5, the driving gear comprises twin portions 16 and 17 disposed about a driving shaft 75 which is engaged with the pivoting motor 13. The half-moon gear in turn comprises twin portions 14 and 15 which meshingly engage with respective twin portions 16 and 17 of the driving gear. Rotation of the drive gear portions 16 and 17 in one direction concomitantly rotates half-moon gear portions 16 and 17 in the opposite direction (please see arrows B and C in FIG. 3). An automatic shut-off is provided on the pivoting arm 4, so that when the unit 2 is completely raised or lowered, the pivoting motor 13 shuts off.

Figure 9:
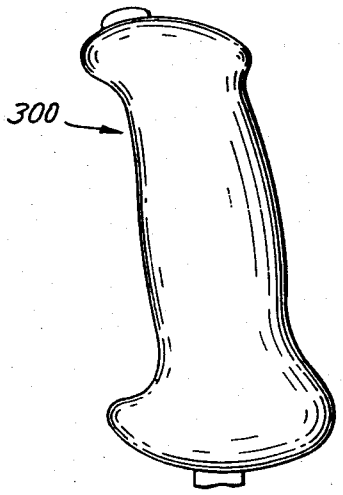
FIG. 9 is a view of a control handle for the bow thruster of the present invention.
Figure 8:
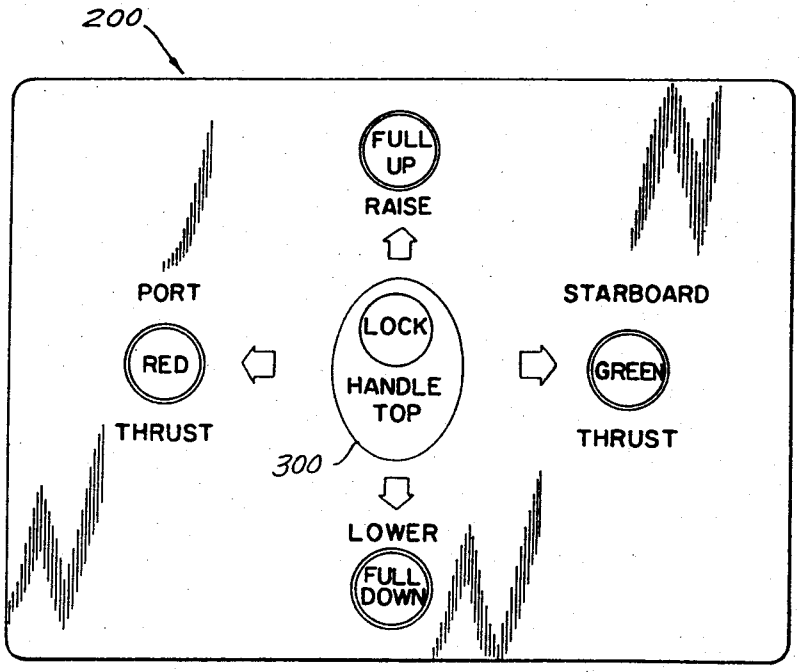
FIG. 8 is a view of a control panel for the bow thruster of the present invention.
Figure 11:
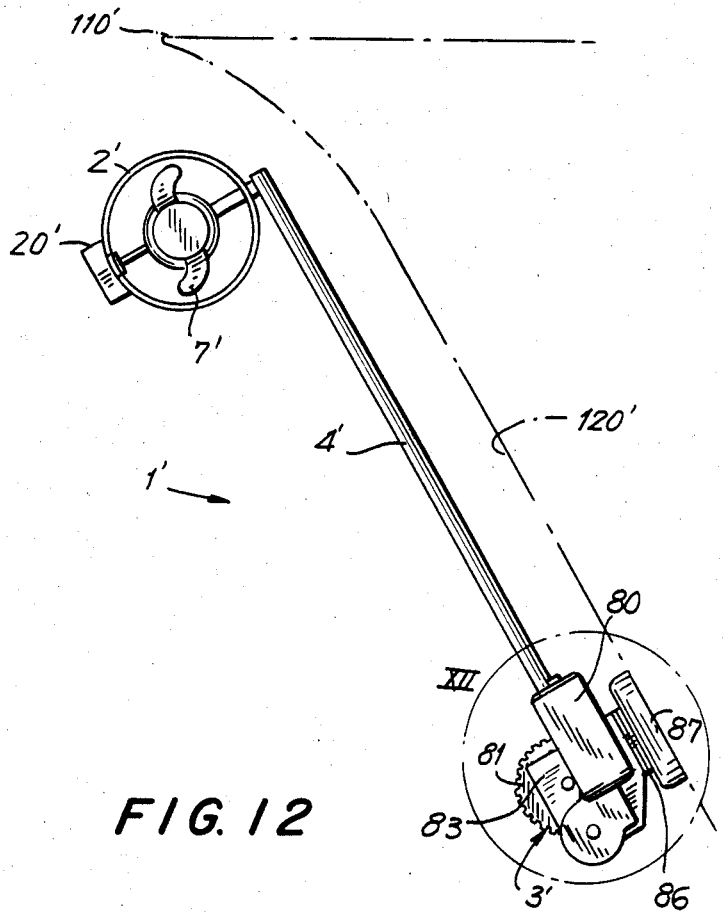
FIG. 11 is a side view of another embodiment in accordance with the present invention.

The pivoting rod 4 is in turn disposed through a recess 73 in the pivoting housing 3, where the rod 4 is affixed to the half-moon gear through a fixed axle 70. Both actuation of the propeller blades 6 and 7 through thrusting motor 50 and pivoting of the thruster unit 2 by pivoting motor 13, are carried out from within the vessel 100, by a control handle 300, with the aid of a control panel 200, as illustrated in FIG. 9 and 8 respectively. More particularly, the handle is illustrated in neutral or "locked" position in FIG. 8. The power is simply turned on and the handle is moved as illustrated in FIG. 8, with respect to the control panel, to either raise or lower the thruster unit 2, i.e., pivot the unit 2 about the housing 3, or to activate the propeller blades 6 and 7 to rotate clockwise or counter clockwise, to thereby pivot the bow 110 of the vessel 100, to starboard or port. Both motors 50 and 13 are battery-activated.

The motor 50 is connected with the control handle 300 and the panel 200 through power cables running through the pivoting rod 4, while the pivoting motor 13 is in turn connected with the handle 300 and panel 200, through cables running in through the hull 101 of the boat 100. Both the bone thruster motor 50 and the pivoting motor 13 operate on a standard 12 volt electrical system. The half-moon gear components 14 and 15 are substantially 180° as illustrated in the appropriate figures. Additionally, the control panel 200 may be mounted on a dashboard within the cabin of the vessel 100, with the controls optionally running through an upper or lower control line, the upper control line being connected over the fly bridge, and the lower control line being connected through the cabin to the various motors 9 and 13, as noted above. Standard ¼ inch bolts may be used for connecting the various brackets 5 and 12, and for connecting the housing 3 to the hull 101 of the boat 100. The pivoting arm 4 itself may be a standard stainless steel one inch diameter hollow tube. Additional support bracketing 76 may be provided about the fixed axle 17 connecting the pivoting rod 4 with the half-moon gear 14, 15, as illustrated in FIG. 5.

The pivotal bow thruster 1 of the present invention operates in the following manner. When it is desired to lower the thruster unit 2, e.g., from the raised position illustrated in phantom in FIGS. 1 and 2, the lock on top of the handle in FIG. 8 is simply released, thereby actuating the various circuits to the respective motors 13 and 50. Then the handle is simply moved towards the lower position illustrated in FIG. 8, which activates the motor 13 to gradually pivot the half-moon gear 14, 15 in a clockwise direction as viewed in FIG. 3. The unit 2 is thereby lowered in the direction of the left-hand arrowhead A in FIG. 3, to the location where the substantially V-shaped seat 20 securely rests about the stem 120 of the vessel 100.

At this point, activation of the thruster unit 2 itself, i.e., of the twin propeller blades 6 and 7, may be carried out. This is accomplished by simply moving the handle 300 to the right or to the left as illustrated in FIG. 8, to thereby accomplish the resultant thrusting of the bow 110 of the boat 100. More particularly, as viewed in FIG. 7, if the propeller blade 6 is caused to rotate clockwise, then the water will be drawn from the port side of the boat to the starboard side of the boat, and consequently the bow 110 of the boat 100 will be thrust to port. Alternatively, if the motor 50 is actuated in reverse, i.e., if the propeller blades are caused to turn in the counterclockwise direction as viewed in FIG. 7, then the bow of the boat will be thrust to starboard.

After the vessel 100 has pushed off the dock, for example, then the thruster unit 2 may be raised by simply moving the handle 300 to the central position illustrated in FIG. 8, and then upwardly to the "raised" position, whereby the motor 13 will be actuated to rotate the half-moon gear 14 and 15 in the counterclockwise direction (arrow C in FIG. 3), thereby raising the thruster unit 2 to the position illustrated in phantom in FIGS. 1 and 2 (in the direction of right-hand arrowhead "A"). At this point, the thruster unit 2 rests just adjacent the pulpit of bowsprit. Thus, when not in use, the thruster unit 2 will be disposed in a convenient location where it will not interfere with any other sailing or movement of the vessel 100 itself.

FIGS. 11–14 illustrate an alternative embodiment which is similar to the embodiment in other figures, with like or similar components being designated by a prime (') symbol after the appropriate reference numeral.

Figure 12:
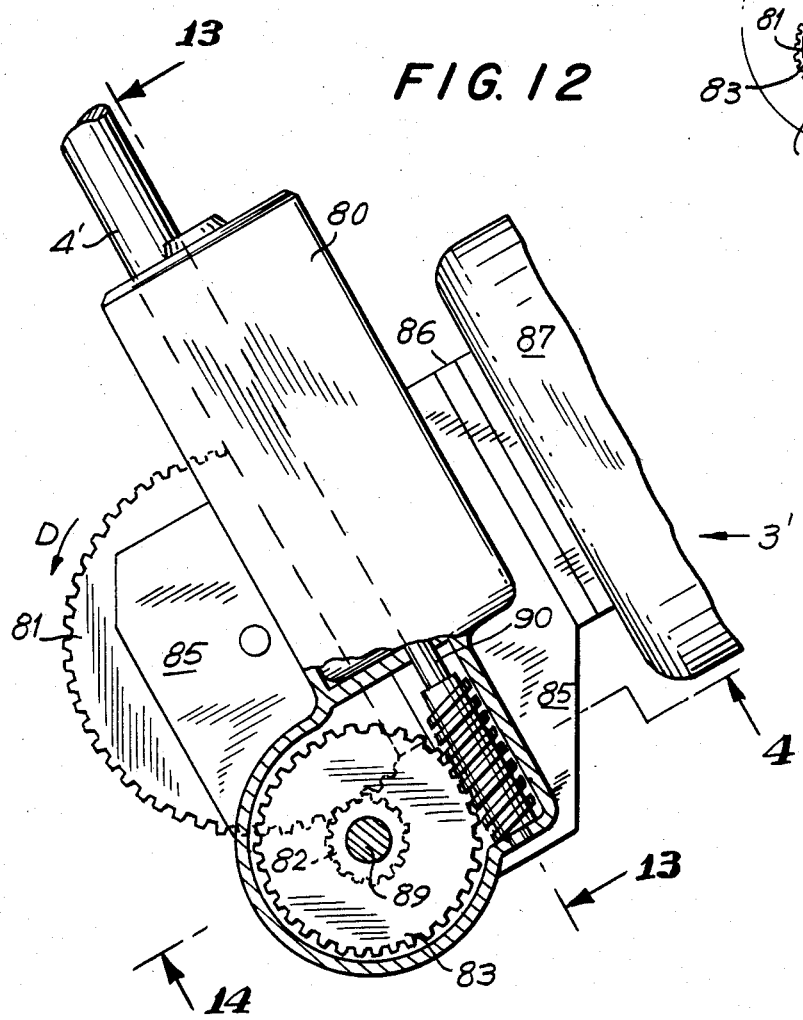
FIG. 12 is an enlarged view, partially in section, of area XII in FIG. 11.
Figure 13:
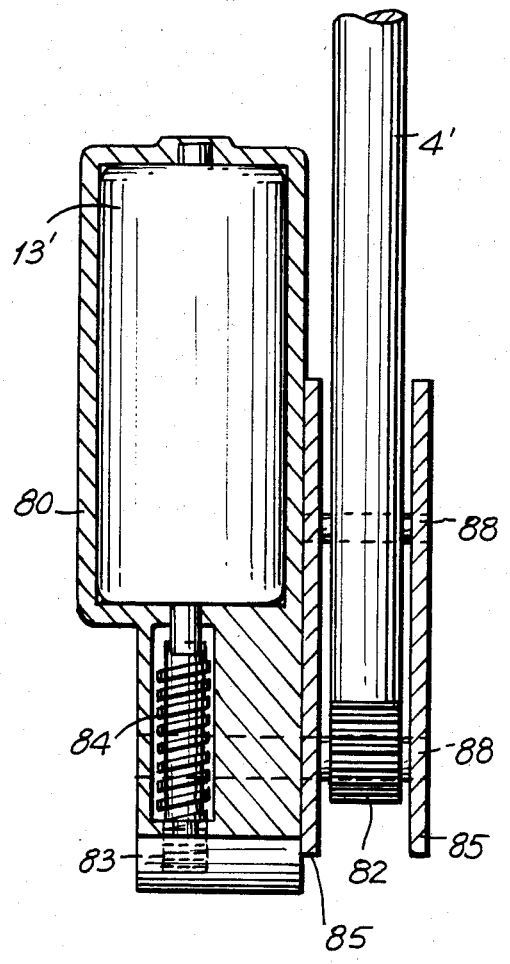
FIG. 13 is a view, partially in section, along line 13—13 in FIG. 12.
Figure 14:
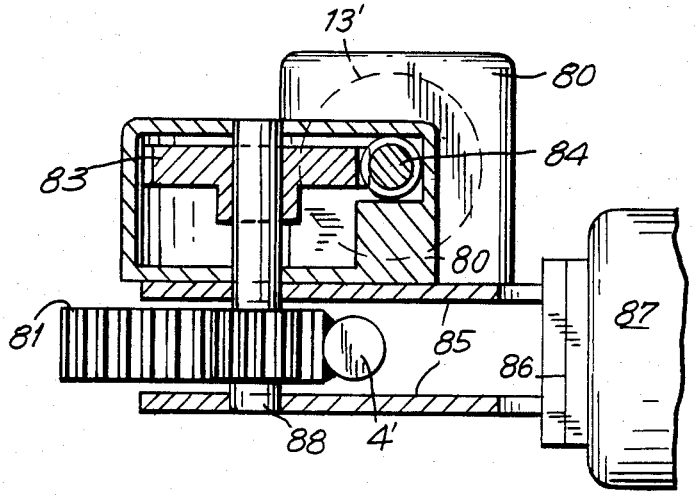
FIG. 14 is a view, partially in section, along line 14—14 in FIG. 12.

In the embodiment illustrated in FIGS. 11–14, the pivoting arm 4' is connected to a gear 81 which is in turn engaged with an intermediate gear 82, 83, situated on an axis 89, so as to be rotatable therewith. The intermediate gear 82, 83 is divided into two portions, namely a smaller external portion 82 engaging gear 81, and a larger internal portion 83, both situated on the axis 89 as illustrated in FIG. 12. The larger intermediate gear portion 83 is engaged with a worm gear 84, which is in turn connected to the pivoting motor 13'. Gear 81 is a round gear, i.e. a "full moon" gear.

A housing 80 encloses the pivoting motor 13', worm gear 84 and the internal intermediate gear portion 83. The entire pivoting mechanism 3' is mounted on the stem 120' of a boat, with a pair of adjustable mounting plates 85 being connected to housing 80 and gear 81 through rivets 88. The mounting plates 85 are in turn connected to a support 87 through a mounting flange 86, the support 87 being mounted on the stem 120' of the boat. The pivoting motor 13' is connected to the control handle 300 and panel 200 in a similar manner as the other embodiments of the invention.

Operation of the pivoting mechanism 3' also takes place in a similar manner to operation of the other embodiment. Movement of the control handle 300 to the lower position in FIG. 8 activates the motor 13' to rotate the worm gear 84 about its axis 90. This in turn rotates both intermediate gear portions 83 and 82 about axis 89, causing gear 81 to rotate clockwise in the direction of arrow D in FIG. 12 to thereby lower the thruster unit 2' into position. The thruster unit 2' may be lifted by moving the handle 300 to the "raised" position, which then actuates the motor 13' to turn the worm gear 84 in the opposite direction. The remaining gears are then all driven in the opposite direction, to raise the thruster unit 2'.

Both the V-shaped seat 18 in FIG. 5, and the bow support 87 in FIG. 12, are laterally adjustable to fit a boat hull of any particular chime or chamfer. In other words, seat portions 18', 18' of V-shaped seat 18 in FIG. 5, are laterally adjustable through mounting brackets (not illustrated) to vary angle E between the same, to thereby accommodate any particular kind of hull. By the same token, mount or support 87 in FIG. 12 comprises laterally portions 87 which are also adjustable (through mounting brackets) with respect to one another, to vary the angle E therebetween.

Figure 15:
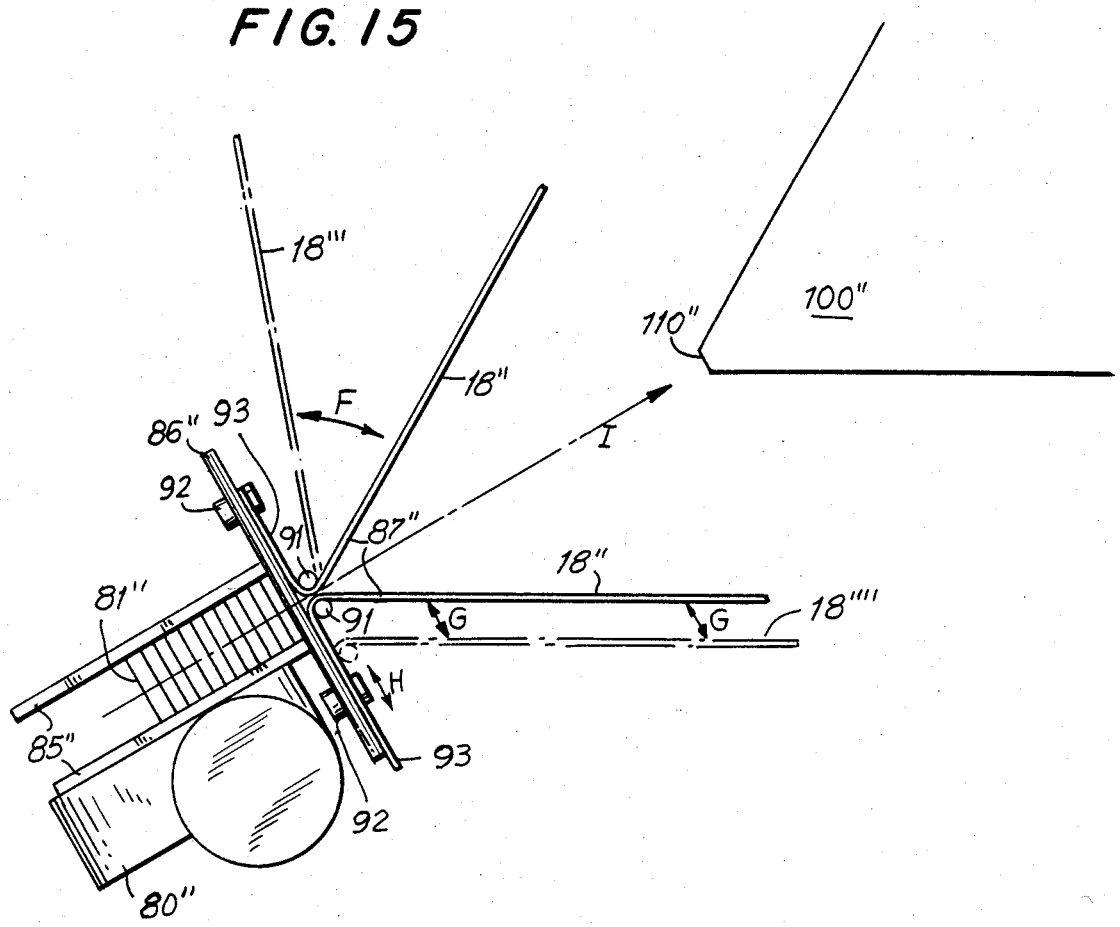
FIG. 15 is a top view of a further embodiment of the present invention.
Figure 16:
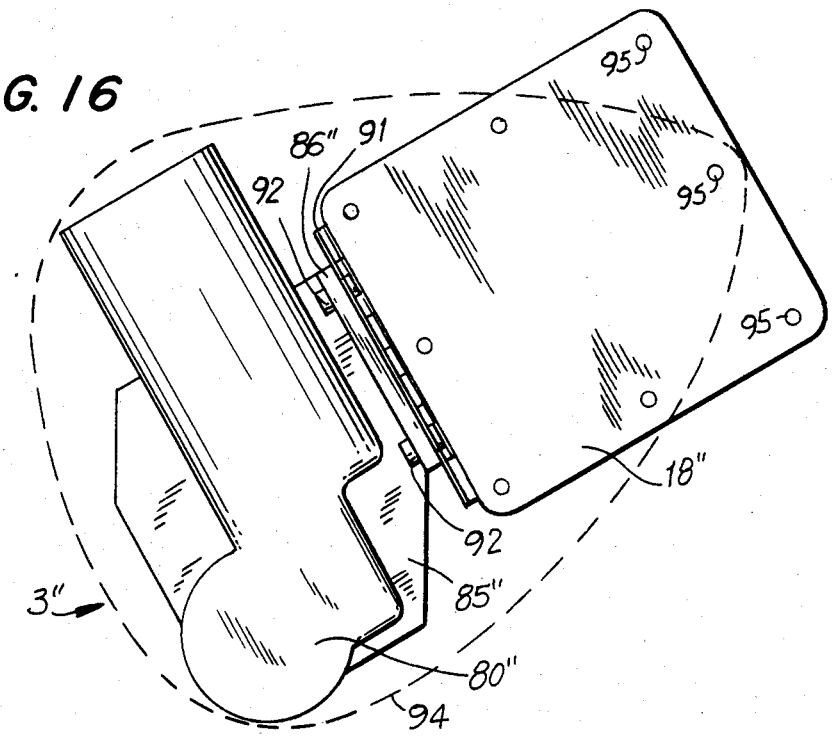
FIG. 16 is a side view of the embodiment illustrated in FIG. 15.

FIGS. 15 and 16 illustrate a further embodiment which is also similar to the embodiments in the other figures, with like or similar components being designated by a double prime (") symbol after the appropriate reference numeral. More particularly, FIGS. 15 and 16 illustrate an adjustable V-shaped seat or support 87", having adjustable seat portions 18", 18". In this particular embodiment, the housing 80"enclosing the pivoting motor and respective gears is mounted on one of two mounting plates 85" which encompass the gear 81" as best seen in FIG. 15. These two mounting plates 85" are in turn connected to a mounting flange 86", on which the seat or support 87"is adjustably mounted.

The seat portions 18", 18" are each adjustably mounted on a respective hinge 91, 91 as best seen in FIG. 15. Thus, the seat portions 18", 18" can be conveniently swung about hinges 91, 91 over an adjusting angle F to accommodate the bow 110" of a boat 100" having any particular chime or chamfer. As illustrated in phantom, the seat portions 18" may be swung to an outermost position 18" about the hinge 91.

Also, the hinges 91 are mounted on respective plates 93 which are slidable along mounting flanges 86", and can be affixed thereto by mounting bolts 92. Each hinge 91 is adjustable in the direction H and over a distance G. For example, as illustrated in phantom in FIG. 15, the plate 18" may be moved to an outermost position 18"" to accommodate a boat having an extremely rounded stem 120". The entire pivoting mechanism 3" is moved in the direction of arrow I to seat against the stem 120" of the vessel 100".

Each seat portion 18" is provided with a series of openings 95 through which bolts (not illustrated) may be inserted to affix the same to the hull 101" of the boat. Additionally, an "egg-shaped" shield may be mounted upon the pivoting mechanism 3", e.g. upon motor housing 80", as illustrated by the dotted line 94 in FIG. 16.

FIG. 17 is a side view of the V-shaped seat portion 18" prior to being secured to flange 86". As illustrated in this figure, the seat portion 18" is engaged with plate 93 through hinge 91. The plate 93 comprises a pair of oblong openings 96 for receiving respective mounting bolts 92. Thus, the mounting plate 93 is slidable along the flange 86" over the width of the respective openings 96. The plate 93 can then be secured in position by tightening bolts 92.

While the seat portion 18" has been illustated with a substantially rectangular shape, it may also be formed to have different shapes, e.g. an "egg" shape as illustrated by the dotted line 18""' in FIG. 17. FIG. 18 is a top view of FIG. 17. As illustrated in this figure, the mounting plate 93 may be rotated about hinge 91 over an angle J, as illustrated in phantom by reference numeral 93' in FIG. 18.

The pivoting rod 4 is generally about 40 inches long, so that with a Bertram 38 boat, the thruster unit 2 is pivoted with a radius of about 40 inches about the housing 3, i.e., to an operable position about 10 inches below the water line of the particular vessel. However, as noted above, the thruster unit 2 is easily adjustable along the pivoting rod 4, to be accommodated on any desired type of water craft.

Therefore, as noted above, the bow thruster of the present invention allows for convenient adjustment into operative or inoperative position with a minimal amount of components, and maximum degree of control. Much needed space is conserved, with the thruster of the present invention being conveniently transferable from boat to boat, and utilizable on any type of water craft. In particular, the substantially v-shaped seats 18, 20 of the housing 3 and thruster unit 2, provide for secure, smooth retention along the stem of the boat, while at the same time allowing for convenient pivoting of the thruster unit 2, with minimal amount of difficulty. Much better utilization of crew is clearly provided with the thruster of the present invention, with overall smooth, safe, docking tremendously enhanced by the present invention.

The preceding description of the present invention is merely exemplary, and is not intended to limit the scope thereof in any way.

What is claimed is:

1. A pivotal bow thruster, adapted to be adjustably situated with respect to a stem of a boat, comprising
- means for thrusting the bow substantially to port or to starboard, comprising
- tow propellers,
- means for actuating spinning of said propellers, and
- a support for said propellers, and
- means for pivoting said thruster about the stem of the boat, comprising
- a pivoting arm engaged with said propeller support,
- means for actuating pivoting of said pivoting arm,
- a gear train engaged with said pivoting arm and with said pivoting actuating means, and
- a support adapted to be mounted on the stem of the boat and supporting said pivoting actuating means,
- wherein said support for said pivoting actuating means comprises a substantially V-shaped seat adapted to snugly seat against the stem of the boat and having laterally adjustable seat portions for varying of an angle therebetween.

2. The thruster of claim 1, wherein said support for said pivoting actuating means additionally comprises a mounting flange, and
- said seat portions each comprise a hinge and a mounting plate, said mounting plate adapted to slide along said mounting flange and be secured in position thereto.

3. The thruster of claim 2, wherein said support for said pivoting actuating means additonally comprises
- a pair of mounting plates connected to said mounting flange, with said pivoting actuating means mounted on one of said mounting plates.

4. The thruster of claim 1, wherein said gear train comprises
- at least one gear affixed to said pivoting arm such that rotation of said at least one gear also rotates said pivoting arm, and
- a worm gear engaged with said pivoting actuating means and with said at least one gear affixed to said pivoting arm, such that rotation of said worm gear about an axis thereof by said pivoting actuating means in turn rotates said at least one gear affixed to said pivoting arm.

5. The thruster of claim 4, wherein said gear train additionally comprises
- an intermediate gear engaged with said worm gear and with said gear affixed to said pivoting arm.

6. The thruster of claim 5, wherein said intermediate gear comprises a portion of larger diameter engaged with said worm gear and a portion of smaller diameter engaged with said gear affixed to said pivoting arm.

7. The thruster of claim 6, additionally comprising
- a housing encompassing said pivoting actuating means, said worm gear, and said larger diameter gear portion.

8. The thruster of claim 7, wherein said support for said pivoting actuating means additionally comprises
- a mounting flange upon which said seat portions are adjustably mounted, and
- a pair of mounting plates connected to said mounting flange, with said housing for said pivoting actuating means mounted on one of said mounting plates, and said gear affixed to said pivoting arm mounted between said mounting plates.

9. The thruster of claim 4, wherein said gear affixed to said pivoting arm is a round gear.

10. The thruster of claim 1, wherein said support for said pivoting actuating means is mountable above a water line of the boat.

11. The thruster of claim 1, wherein said pivoting actuating means are constituted by a motor mounted on said support for said pivoting actuating means.

12. The thruster of claim 1, wherein said propeller support is constituted by a housing encompassing said propellers.

13. The thruster of claim 12, wherein said propeller actuating means comprise a motor disposed in said propeller support housing.

14. The thruster of claim 1, additionally comprising
- means for adjusting position of said propeller support along said pivoting arm.

15. The thruster of claim 14, wherein said adjusting means comprise
- an adjustable bracket affixed to said propeller support, and adapted to surround said arm, and means for tightening said bracket about said arm.

16. The thruster of claim 1, wherein said propeller support additionally comprises
- a substantially V-shaped seat adapted to rest along the stem of the boat.

17. The thruster of claim 12, wherein said propeller support housing comprises two openings, each opening adjacent a respective propeller, said housing having a substantially cylindrical cross-section.

18. The thruster of claim 1, wherein said thrusting means and said pivoting arm are rotatable both to an operative position wherein said thrusting means seat along the stem of the boat below a water line of the same, and to an inoperative position wherein said pivoting arm is adjacent to the stem and said thrusting means are adjacent the bow or bowsprit of the boat.

19. The thruster of claim 1, wherein said propeller and pivoting actuating means comprise
- a control handle disposed within or on the boat.

20. A pivotal bow thruster adapted to be adjustably situated with respect to a stem of a boat, comprising
- means for thrusting the bow substantially to port or to starboard, comprising
- two propellers,
- means for actuating spinning of said propellers, and
- a support for said propellers, and
- means for pivoting said thruster about the stem of the boat, comprising
- a pivoting arm engaged with said propeller support,
- means for actuating pivoting of said pivoting arm, and
- a gear train engaged with said pivoting arm and with said pivoting actuating means,
- wherein said gear train comprises at least one gear affixed to said pivoting arm such that rotation of said at least one gear also rotates said pivoting arm, and a worm gear engaged with said pivoting actuating means and with said at least one gear affixed to said pivoting arm, such that rotation of said worm gear about an axis thereof by said pivoting actuating means in turn rotates said at least one gear affixed to said pivoting arm, wherein said gear train additionally comprises an intermediate gear engaged with said worm gear and with said gear affixed to said pivoting arm, wherein said intermediate gear comprises a portion of larger diameter engaged with said worm gear, and a portion of smaller diameter engaged with said gear affixed to said pivoting arm, additionally comprising a housing encompassing said pivoting actuating means, said worm gear, and said larger diameter intermediate gear portion, and wherein said housing for said pivoting actuating means comprises a substantailly V-shaped seat, adapted to snugly seat against the stem of the boat.

21. The thruster of claim 20, wherein said seat comprises laterally-adjustable seat portions for varying of an angle therebetween.

22. The thruster of claim 21, wherein said housing for said pivoting actuating means additionally comprises a mounting flange, and said seat portions each comprise a hinge and a mounting plate, said mounting plate adapted to slide along said mounting flange and be secured in position thereto.

* * * * *